US008726969B2

(12) United States Patent
Lin

(10) Patent No.: US 8,726,969 B2
(45) Date of Patent: May 20, 2014

(54) MULTI-FUNCTION SHADE ASSEMBLY AND METHOD

(76) Inventor: Owen Lin, Raleigh, NC (US)

( * ) Notice: Subject to any disclaimer, the term of this patent is extended or adjusted under 35 U.S.C. 154(b) by 0 days.

(21) Appl. No.: 13/409,822

(22) Filed: Mar. 1, 2012

(65) Prior Publication Data

US 2012/0222824 A1 Sep. 6, 2012

Related U.S. Application Data

(60) Provisional application No. 61/449,228, filed on Mar. 4, 2011.

(51) Int. Cl.
*E06B 9/08* (2006.01)

(52) U.S. Cl.
USPC ..... 160/108; 160/89

(58) Field of Classification Search
USPC ..... 160/108, 98, 112, 170, 171, 121.1, 120, 160/84.03, 89, 38
See application file for complete search history.

(56) References Cited

U.S. PATENT DOCUMENTS

| | | | | | |
|---|---|---|---|---|---|
| 2,702,081 | A * | 2/1955 | North et al. | 160/120 |
| 3,183,033 | A * | 5/1965 | Stulbach | 296/97.2 |
| 3,265,116 | A * | 8/1966 | Guffan | 160/121.1 |
| 4,724,885 | A * | 2/1988 | Chang | 160/89 |
| 4,921,031 | A * | 5/1990 | Wagner et al. | 160/38 |
| 4,953,610 | A * | 9/1990 | Phillips et al. | 160/84.03 |
| 5,205,334 | A | 4/1993 | Judkins | |
| 5,505,418 | A | 4/1996 | Corcoran | |
| 5,647,421 | A | 7/1997 | Hoffmann et al. | |
| D445,621 | S | 7/2001 | Judkins | |
| D473,743 | S | 4/2003 | Judkins | |
| 6,662,845 | B1 | 12/2003 | Palmer | |
| 6,712,115 | B2 * | 3/2004 | Judkins | 160/32 |
| 6,941,996 | B2 * | 9/2005 | Ward et al. | 160/89 |
| 6,964,291 | B2 | 11/2005 | Judkins | |
| 6,988,526 | B2 | 1/2006 | Judkins | |
| 7,124,801 | B2 | 10/2006 | Ng et al. | |
| 7,134,470 | B2 | 11/2006 | McCance | |
| 7,389,565 | B2 | 6/2008 | Cheng | |
| 7,562,689 | B1 * | 7/2009 | Militello et al. | 160/84.04 |
| 7,654,299 | B2 | 2/2010 | LeBlanc et al. | |
| D624,805 | S | 10/2010 | Clarke | |
| 7,806,159 | B2 | 10/2010 | Rossato et al. | |
| 2007/0084567 | A1 * | 4/2007 | Chen | 160/84.05 |
| 2007/0246170 | A1 * | 10/2007 | Marzilli | 160/89 |
| 2008/0295975 | A1 | 12/2008 | Lin | |
| 2010/0126673 | A1 | 5/2010 | Lin | |
| 2010/0294438 | A1 * | 11/2010 | Kirby et al. | 160/84.04 |
| 2010/0307698 | A1 * | 12/2010 | Perkowitz | 160/108 |
| 2011/0146918 | A1 * | 6/2011 | Vestal | 160/84.06 |
| 2011/0247763 | A1 * | 10/2011 | Hu et al. | 160/84.03 |

* cited by examiner

*Primary Examiner* — David Purol
(74) *Attorney, Agent, or Firm* — Dilworth & Barrese, LLP

(57) ABSTRACT

A double shade includes a head rail, at least one end cap having an end panel disposed with the head rail and a bracket arm extending from the end panel, a first window treatment being disposed with the head rail, a second window treatment being disposed with the bracket arm, and a clip engaged with the first window treatment and the second window treatment. A double shade includes a head rail extending between first and second ends, first and second end caps including respective end panels mounted with the first and second ends of the head rail and respective bracket arms extending from the end panels, a cellular shade mounted with the head rail, and a roller shade extending between first and second ends respectively mounted with the bracket arms of the first and second end caps, wherein the cellular shade is independently movable relative to the roller shade.

17 Claims, 12 Drawing Sheets

FIG. 22A
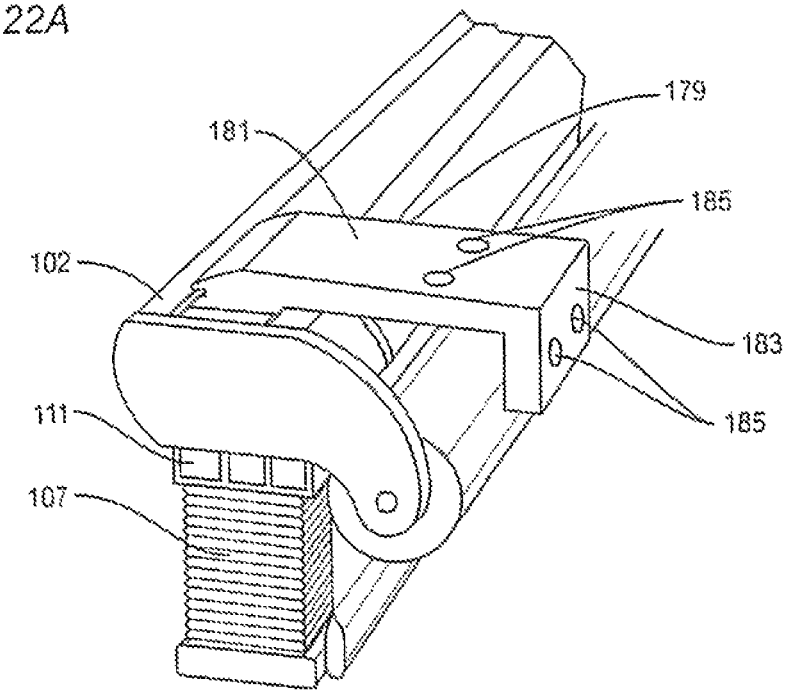
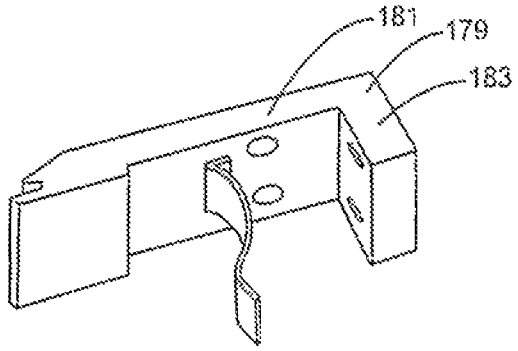
FIG. 22B

MULTI-FUNCTION SHADE ASSEMBLY AND METHOD

CROSS REFERENCE TO RELATED APPLICATIONS

The present application claims priority to U.S. provisional application No. 61/449,228 filed Mar. 4, 2011, which is herein incorporated by reference.

TECHNICAL FIELD

The present disclosure generally relates to window treatments, and more particularly to double shades and related hardware.

BACKGROUND

Individuals occupying a building space including unadorned windows may from time to time wish to have some means of improving the appearance of the windows, blocking sunlight from entering the building space through the window, or preventing others from observing them by peering through the window. Window treatments are well known for covering windows and adjacent areas. Window treatments are available in various devices such as, for example, curtains, drapes, blinds, and shades. These devices can be used in many applications, including use for provision of visual barriers, physical separation, privacy, protection from strong sunlight, and decoration.

Some window coverings incorporate cellular style shades. For example, cellular shades having the beautiful quality of transmitting soft light are known. However, such shades typically lack the ability to fully block the transmission of light when desired. Cellular shades having the ability to fully block out light are also known. However, such shades are typically of limited use, either providing no privacy, or total blackout. This disclosure describes an improvement over these prior technologies.

SUMMARY OF THE INVENTION

The present disclosure generally relates to window treatments, and more particularly to cellular style window shades.

In one embodiment, in accordance with the principles of the present disclosure, a double shade is provided. The double shade apparatus includes (a) a body component including a head rail; (b) first and second end panels attached respectively to opposite ends of the head rail, each end panel having a bracket; (c) a roller shade apparatus releasably mountable between the brackets of the first and second end panels; (d) a second shade apparatus mounted to the head rail; and, (e) a clip for releasably engaging the roller shade apparatus with the second shade apparatus.

In one embodiment, in accordance with the principles of the present disclosure, a double shade is provided. The double shade includes a head rail extending between a first end and a second end, a first end cap including an end panel mounted to the first end of the head rail and a bracket arm extending from the end panel, a second end cap including an end panel mounted to the second end of the head rail and a bracket arm extending from the end panel, a cellular shade mounted with the head rail, and a roller shade extending between a first end and a second end, the first end of the roller shade mounted with the bracket arm of the first end cap and the second end of the roller shade mounted with the bracket arm of the second end cap. The cellular shade is independently movable relative to the roller shade.

In one embodiment, in accordance with the principles of the present disclosure, a method for manufacturing a double shade is provided. The method includes providing a head rail, providing at least one end cap including an end panel and a bracket arm extending therefrom, providing a first window treatment, providing a second window treatment, providing a clip, mounting the end cap with the head rail, mounting the first window treatment with the head rail, mounting the second window treatment with the bracket arm, and mounting the clip with the first window treatment and the second window treatment.

As shown in the appended drawings and described herein, the present disclosure provides improved window treatment technology relating to cellular shades. It is envisioned that the improved window treatment technology provided by the present disclosure is fully and completely applicable to other types of shades, including but not necessarily limited to other decorative window treatments, such as Roman style shades, blinds, etc. that drop down or are lowered down from above an architectural feature such as a window or alcove. In the case of blinds, a roller shade that provides privacy with at least some light transmission can be used in replacement of a black-out roller shade. In other embodiments in accordance with the principles of the present disclosure, a black-out cellular shade is used in replacement of a black-out roller shade. A double shade designed and fabricated in accordance with the principles of the present disclosure may be configured for sale as an entire unit. Alternatively, a double shade designed and fabricated in accordance with the principles of the present disclosure may be configured to be augmented with one or more different roller shades that can be sold separately to grant consumers the ability to achieve whatever aesthetic effect or light-transmission effect they may desire. Accordingly, to the extent any roller shade, other type of shade, or blind is described herein as part of a double shade, it is envisioned either with respect to such embodiment, or with respect to one or more alternative embodiments or variations, that any one or more of the roller shade, the other type of shade, or blind may be configured to be removed from the overall assembly and to be replaced with other shade components to allow for mixing and matching of roller, shade, and/or blind combinations.

BRIEF DESCRIPTION OF THE DRAWINGS

The present disclosure will become more readily apparent from the specific description accompanied by the following drawings, in which:

FIGS. 22A and 22B include perspective views of the invention including mounting brackets;

Like reference numerals in at least the tens and units digits indicate the same or similar parts throughout the figures.

DETAILED DESCRIPTION OF THE INVENTION

The present disclosure generally relates to window treatments, and more particularly to double shades, for example, those including cellular style window shades. It is envisioned that the shade assemblies disclosed herein may be operated manually, including either via the use of a free-hanging end portion of a lift cord, or without such a lift cord by means of one or more lifting mechanisms.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, left and right, are for illustrative purposes only and can be varied within the scope of the disclosure. For example, the references "upper" and "lower" are relative and used only in the context to the other, and are not necessarily "superior" and "inferior".

Figure 1:
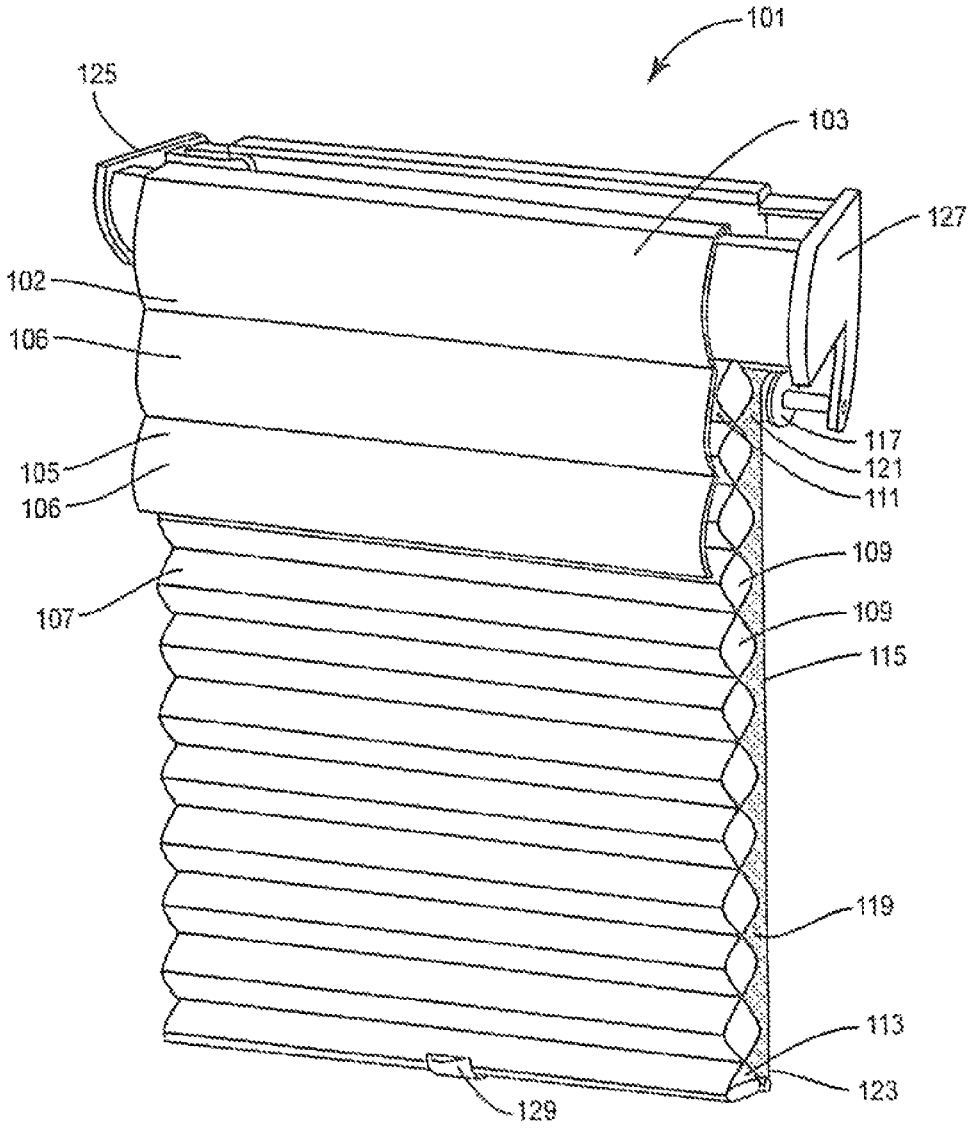
FIG. 1 is a downward front perspective view of one embodiment of a shade assembly in a vertically extended configuration in accordance with the principles of the present disclosure.

The following discussion includes a description of particular examples of shade assemblies and related methods of assembly, modification, and/or upgrade in accordance with the principles of the present disclosure. Alternate embodiments are also disclosed. Reference will now be made in detail to the exemplary embodiments of the present disclosure, which are illustrated in the accompanying figures. Turning now to FIG. 1, a double shade, such as, for example, a shade assembly 101 in accordance with embodiments of the present disclosure is shown. The shade assembly 101, shown in an extended vertical configuration in FIG. 1, includes a body component 102 including a head rail 103 and a skirt 105 having multiple vertically arranged horizontal segments 106, a first window treatment, such as, for example, a cellular shade 107 including multiple cells 109 and an upper margin 111 and a lower margin 113, a second window treatment, such as, for example, a roller shade 115 including a roller 117 and a shade panel 119 having an upper margin 121 and a lower margin 123, a left end cap 125 slidably mounted to a left end of the head rail 103, a right end cap 127 slidably mounted to a right end of the head rail 103, and a clip component 129. It is contemplated that one or more of the components of the double shade may be assembled, monolithically formed and/or integrally connected.

The cellular shade 107 is suspended directly from the head rail 103 via the upper margin 111 of the cellular shade 107 and is configured and equipped to extend downward from the head rail 103, and to be retracted back toward the head rail 103 where the cells 109 are collected and collapsed in the conventional manner. The cellular shade 107 is preferably a cordless shade, spring-loaded and capable of being controlled with a slight lift or pull of a finger applied to the lower margin 113 of the cellular shade 107, or to the clip component 129. Alternatively, a conventional cord control may be used, or retractable cord controls, cord loops, and remote control motorized lift options. The cellular shade 107 may be fastened underneath the head rail 103 through holes that allow connection to the tensioning mechanics (not shown) contained within the head rail 103. There is a strong interest to keep all components as cord inaccessible as possible. Due to previous accidents and fatalities involving infants and children becoming tangled in shade lift cords, so-called cord-free or cordless shades/rollers/blinds have been increasing in number and variety. To the extent cords are accessible, some designs provide for breakaway cords to reduce the possibility of entanglement with a suspended cord system. Embodiments of the shade assembly 101 in accordance with the principles of the present disclosure encompass shades/rollers/blinds that are cord-free, cordless, and/or incorporate breakaway cords.

The roller 117 of the roller shade 115 is coupled at one end to the left end cap 125 and at an opposite end to the right end cap 127. The shade panel 119 of the roller shade 115 is coupled to the roller 117 at the upper margin 121 of the shade panel 119 and is configured to extend downward from the head rail 103, and to be retracted back toward the head rail 103 for conventional collection by the roller 117. In an embodiment shown in more detail below and illustrated in FIGS. 23 and 24, the roller shade 115 is spring loaded and capable of being controlled with a slight lift or tug of a finger applied to the lower margin 123 of the shade panel 119 of the roller shade 115, or to the clip component 129. In embodiments of the shade assembly 101, the roller shade 115 includes a non-locking spring mechanism. In embodiments of the shade assembly 101, the roller shade 115 is a pull draw style shade in which a slight pull down releases an internal lock that allows the roller to wind up to a desired height. Further details regarding a spring loaded embodiment of the shade are discussed below in connection with FIGS. 23 and 24.

The lower margin 113 of the cellular shade 107 is coupled to the clip component 129. The lower margin 123 of the shade panel 119 of the roller shade 115 is coupled to the clip component 129. Accordingly, the lower margin 113 of the cellular shade 107 and the lower margin 123 of the shade panel 119 of the roller shade 115 are indirectly coupled to each other via the clip component 129. In accordance with embodiments of the present disclosure, the cellular shade 107 and the roller shade 115 are capable of being lowered and raised in unison relative to the head rail 103 by a user grasping and/or manipulating the clip component 129 as needed or as desired. The structure and function of the clip component 129 are discussed further below.

The skirt 105 is connected to the head rail 103 and extends downward therefrom. The segments 106 of the skirt 105 present a bumped or scalloped appearance to the skirt 105. Other configurations of the skirt are possible, including as described below. The skirt 105 functions to obscure a view of the cellular shade 107 and the roller shade 115 when the same are fully retracted positions adjacent to or against the head rail 103.

Figure 2:
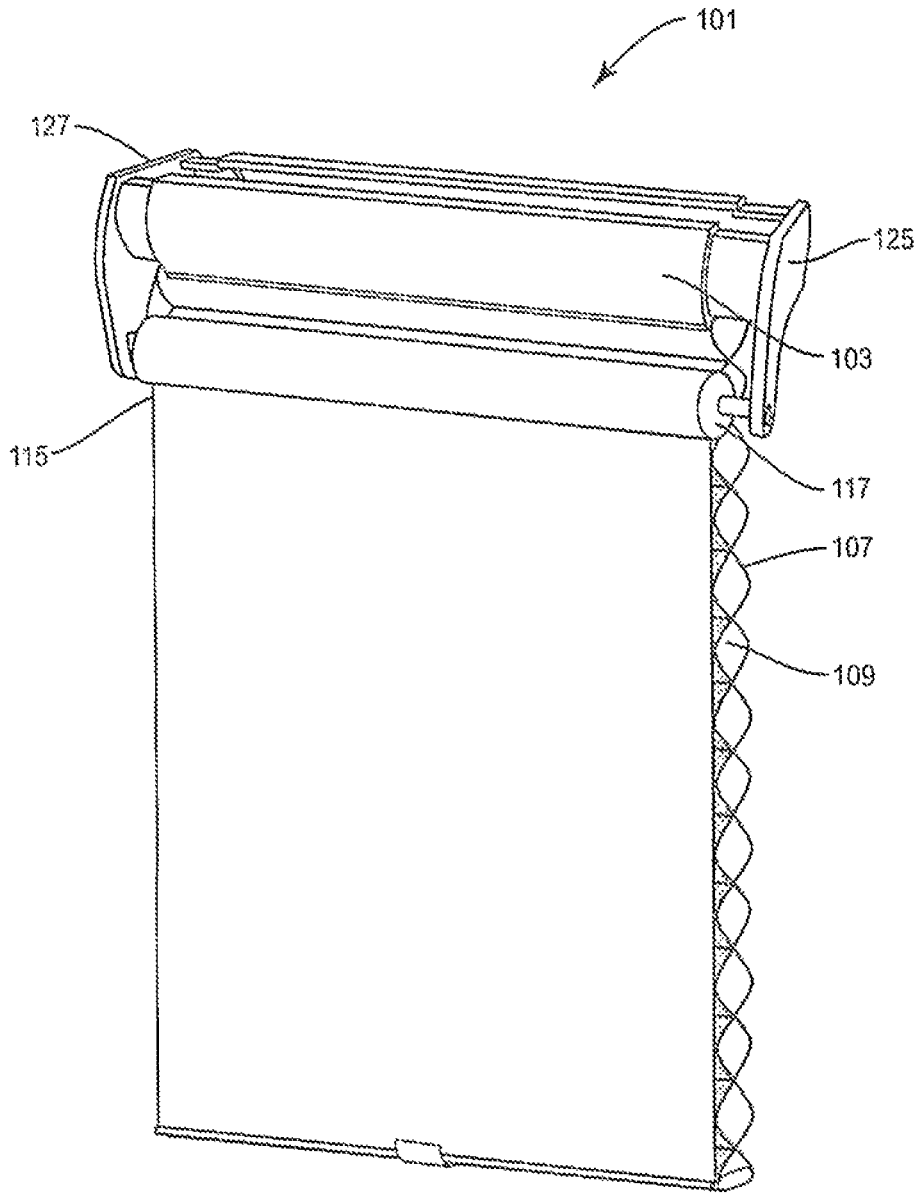
FIG. 2 is a downward rear perspective view of the shade assembly of FIG. 1.

Turning now to FIG. 2, the roller 117 of the roller shade 115 is mounted to the left and right end caps 125, 127 behind the cellular shade 107 and beneath the head rail 103.

The shade assembly 101 is a multi-functional shade product that offers a user and/or homeowner the option to choose a fully open window, privacy with soft light transmission through the cells 109 of the cellular shade 107, or full blackout capability via the use of the roller shade 115, all in one system. The shade assembly 101 is a double mechanism including a cellular shade 107 and a roller shade 115 housed together and capable of being operated manually in unison.

The embodiment shown in FIGS. 1 and 2 includes a vinyl blackout roller behind a cell shade (roller/cell). Other combinations of shades are possible, such as, for example, cell/cell, roller/Roman, and Roman/cell, etc.

The embodiment shown in FIGS. 1 and 2 includes a fixed roller/fixed cell configuration. Other configurations are possible, such as, for example, fixed roller/TDBU (top down bottom up) cell, TBDU roller/fixed cell, and TBDU roller/TBDU cell, as discussed further below.

Figure 3:
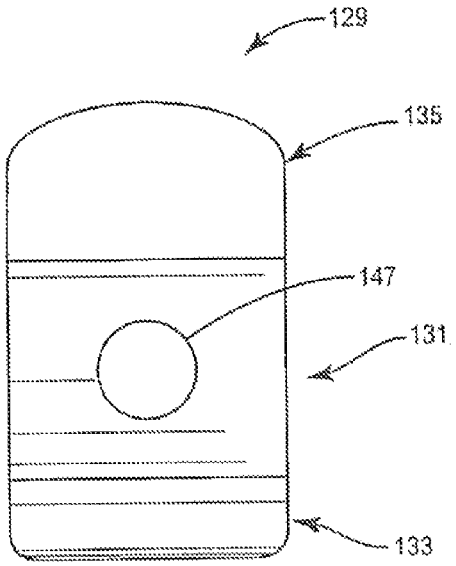
FIG. 3 is a plan view of a clip component of the shade assembly of FIG. 1.
Figure 4:
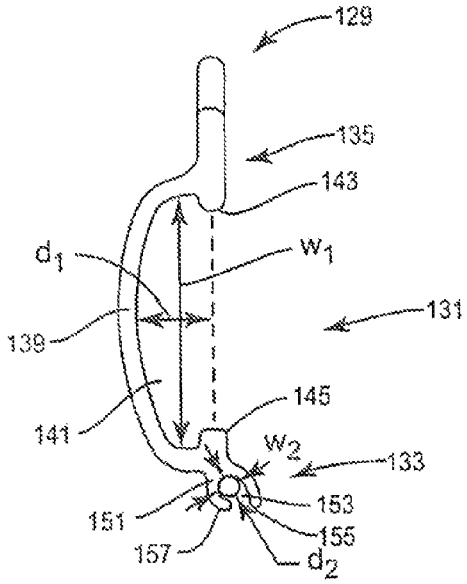
FIG. 4 is a side elevational view of the clip component of FIG. 3.
Figure 5:
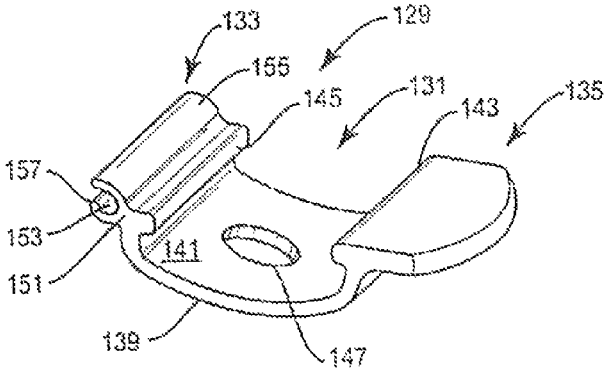
FIG. 5 is a downward side perspective view of the clip component of FIG. 3.

Turning now to FIGS. 3, 4 and 5, the clip component 129 includes a first clip 131 associated with the cellular shade 107 (FIG. 1), a second clip 133 associated with the roller shade 115 (FIG. 1), and a handle 135.

Figure 6:
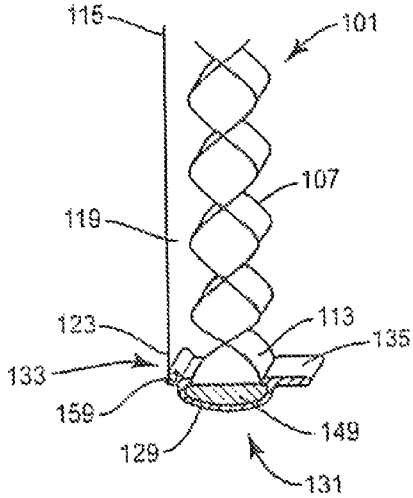
FIG. 6 is a downward side perspective detail view in partial cross section of the shade assembly of FIG. 1.

As shown in FIG. 6, the first clip 131 of the clip component 129 is attached to the cellular shade 107, and the second clip 133 of the clip component 129 is attached to the roller shade 115. More particularly, and referring now to FIGS. 3, 4, 5, and 6, the first clip 131 includes walls 139 defining a pocket 141, a rim above the pocket 141 defined by opposing lips 143, 145, and a through hole 147. The through hole 147 is optional, and may be provided for one or more functional reasons, for aesthetic reasons, or to reduce the total amount of material used to fabricate the clip component 129. If provided for aesthetic reasons, the clip component 129 may include a plurality of through holes 147 arranged as desired. If provided for one or more functional reasons, the through hole 147 may be configured and dimensioned to receive a corresponding screw or other fastener (not specifically shown) for securely fastening the first clip 131 to the cellular shade 107 as necessary and/or as desired. The walls 139 of the pocket 141 and the lips 143, 145 of the rim are configured and dimensioned to receive, and to securely and selectively releasably retain a bottom rail 149 of the cellular shade 107 disposed at the lower margin 113 thereof. In an embodiment, the pocket 141 has a width $w_1$ in a range of from about 33 mm to about 35 mm and a depth $d_1$ below the lips 143, 145 in range of from about 8 mm to about 15 mm. The second clip 133 includes walls 151 defining a C-shaped pocket 153, and a rim above the pocket 153 defined by opposing lips 155, 157. The walls 151 of the pocket 153 and the lips 155, 157 of the rim are configured and dimensioned to receive, and to securely and selectively releasably retain a bottom rail 159 of the shade panel 119 of the roller shade 115 disposed at the lower margin 123 thereof. In an embodiment, the pocket 153 has a width $w_2$ in a range of from about 4 mm to about 7 mm and a depth $d_2$ below the lips 155, 157 in a range of from about 15 mm to about 20 mm. It is envisioned that the range of values for the above-discussed dimensions will change depending on the dimensions of the bottom rails 149, 159 respectively. Alternative embodiments of the clip component 129 are possible in accordance with embodiments of the present disclosure, such as, for example, as shown and described below with respect to FIGS. 7-9.

Figure 7:
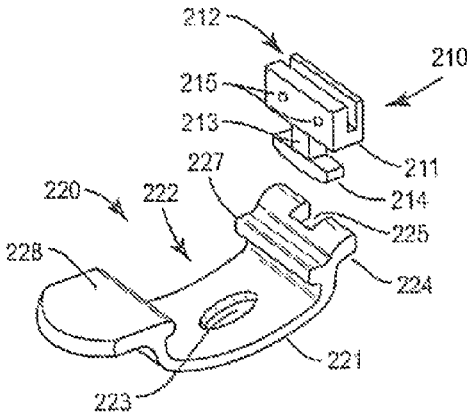
FIGS. 7-9 illustrate an alternative embodiment of the clip components of the shade assembly.
Figure 8:
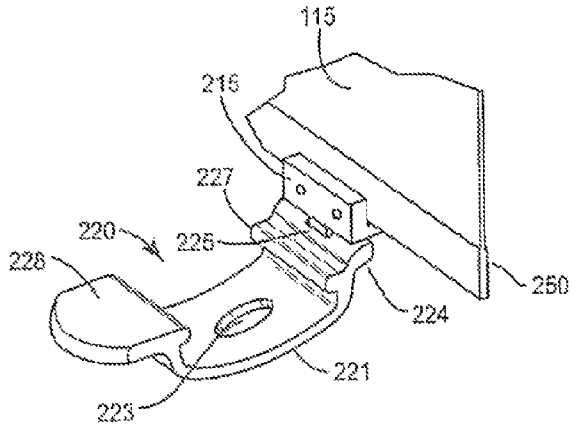
Figure 9:
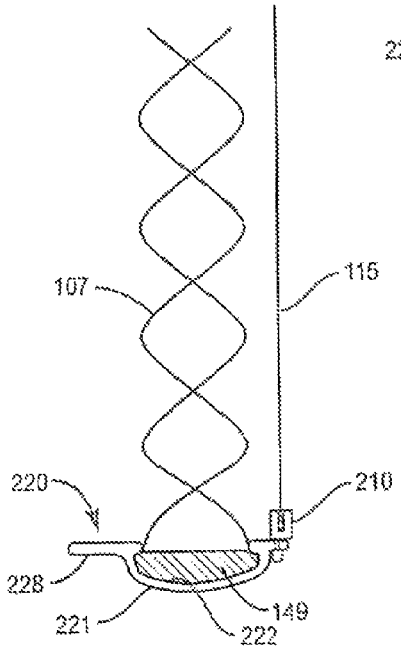

Referring now to FIGS. 7, 8 and 9, in an embodiment a dual clip system includes a latch member 210 for attachment to roller shade 115 and a shade clip 220 for attachment to cellular shade 107. The latch member 210 and the shade clip 220 are releasably engagable with each other to join the bottom portion of the roller shade 115 with the bottom portion of the cellular shade 107.

More particularly the latch member 210 includes a U-shaped body 211 defining a slot 212, a column 213 depending from the bottom of the U-shaped body 211, and a lateral hook portion 214 attached to the bottom of column 213. Optionally, the latch member 210 can include fasteners 215 (e.g. screw fasteners, bolts, etc.) extending laterally through at least one side of the U-shaped portion 211. The latch member 210 can be of monolithic construction and can be fabricated from any suitable material such as metal, plastic or wood.

The shade clip 220 includes an arcuate body 221 defining a pocket 222 into which the bottom rail 149 of the cellular shade 107 may be retained. A through hole 223 can be provided in arcuate body 221 as described above with respect to clip component 129. Laterally extending lips 226 and 227 are configured and dimensioned to hold the bottom rail 149 in the pocket 222. The shade clip 220 further includes on one side a laterally extending catch 224 having a notch 225 configured and dimensioned to engage the column 213 of the latch member 210. On an opposite side the shade clip 220 includes a laterally extending tab 228. The shade clip 220 can be of monolithic construction and can be fabricated from any suitable material such as metal or plastic.

In an embodiment, at least one of the latch member and shade clip (210, 220) is magnetic, the other being fabricated from a ferrous material or also being magnetic. The magnetic attraction between the latch member and shade clip 210 and 220 helps prevent inadvertent disengagement of the latch member and shade clip once they are engaged.

As shown if FIGS. 8 and 9, the bottom rail 250 of the roller shade 115 is mounted in the gap 212 of the U-shaped body 211 of the latch member 210. Rail 250 can be secured to the latch member 210 by fasteners 215. The bottom rail 149 of the cellular shade 107 is mounted in the pocket 222 of the second shade clip 220.

Referring again now to FIGS. 4 to 6, the handle 135 extends toward the user on a side of the shade assembly 101 corresponding to the cellular shade 107, which in most instances will be the side of the shade assembly 101 that faces into a room in which the shade assembly 101 is located, and outward of an architectural feature, such as a window or alcove, immediately adjacent to which the shade assembly 101 is mounted. The handle 135 is configured, dimensioned, and arranged relative to the other components of the shade assembly 101 to permit a user facing the shade assembly 101 in the room in which the shade assembly 101 is located to raise and lower the cellular shade 107 and the roller shade 115 in unison relative to the head rail 103 (FIG. 1) by grasping the handle 135 of the clip component 129, and manipulating the same as needed and/or as desired.

Figure 10:
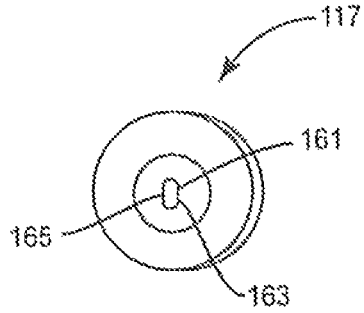
FIG. 10 is a side perspective view of the roller of the roller shade of the shade assembly of FIG. 1.

Turning now to FIG. 10, the roller 117 of the roller shade 115 of FIG. 1 is shown in end view. The roller 117 includes a pin 161 extending outward of the paper of FIG. 10 and toward the viewer. The pin 161 features opposing flat surfaces 163, 165 configured and dimensioned to interoperate with corresponding reaction surfaces of a pocket within which the pin 161 is received, as discussed further below. The pin 161 is operably coupled to a spring motor (not separately shown) disposed within the roller 117, and that supplies the roller 117 with the energy or power needed to raise (or assist in raising) the shade panel 119 (FIG. 1) of the roller shade 115 (FIG. 2) toward the head rail 103 (FIG. 2). The roller 117 is a non-locking roller, offering constant winding tension. Other configurations for the roller 117 are possible. For example, the roller 117 may be a locking roller, offering winding tension only when it is not locked. Additionally the roller 117 may be a so-called 'Smart Shade' that can be raised and lowered with a lift or pull applied to the bottom rail 159 (in which case the action may being similar to that of a cordless "Bottom Up" cellular shade).

Figure 11:
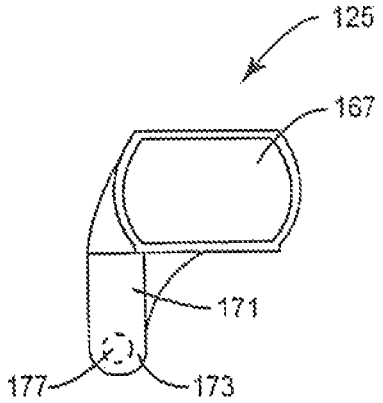
FIG. 11 is an end view of a left end cap of the shade assembly of FIG. 1.
Figure 12:
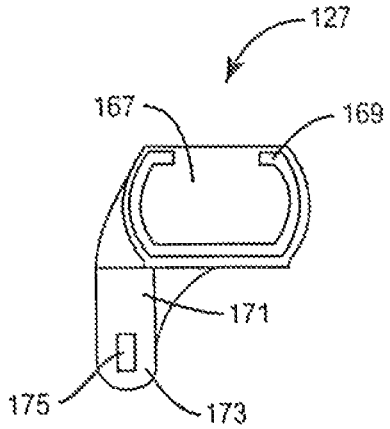
FIG. 12 is an end view of a right end cap of the shade assembly of FIG. 1.

Referring now to FIGS. 11 and 12, each of the left end cap 125 and the right end cap 127 includes an end panel 167, a tongue or projection 169 joined to and extending sideways from the end panel 167 and dimensioned and configured to be securely slidably received in a corresponding similarly shaped opening in the head rail 103 (see FIG. 1), and a bracket arm 171 joined to and extending downwardly and rearwardly from the end panel 167, each of the bracket arms 171 including an end 173 at which the left and right end caps 125, 127 are operably coupled to the roller 117 (FIG. 10) of the roller shade 115 (FIG. 1). At the end 173 of the bracket arm 171 of the right end cap 127, a hole 175 is defined, and at the end 173 of the bracket arm 171 of the left end cap 125, a hole 177 is defined. The hole 175 is rectangular in shape to receive the similarly shaped pin 161 (FIG. 10) of the roller 117, and to prevent the pin 161 from rotating relative to the right end cap 127 in accordance with conventional roller shade functionality. The hole 177 is circular in shape to receive a cylindrically shaped pin (see FIG. 2) on the opposite side of the roller 117 (FIG. 2) and to allow such pin to rotate relative to the left end cap 125, also in accordance with conventional roller shade functionality.

Figure 13:
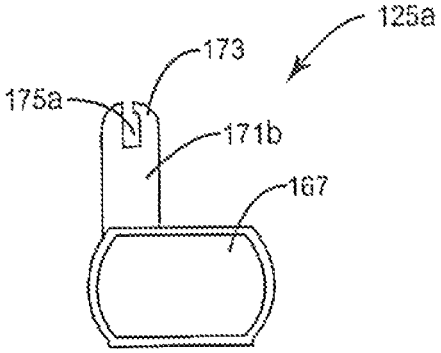
FIG. 13 is an end view of a modified version of the left end cap of FIG. 1.
Figure 14:
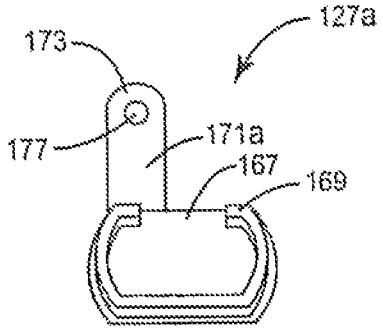
FIG. 14 is an end view of a modified version of the right end cap of FIG. 1.

Referring now to FIGS. 13 and 14, alternative configurations for the left and right end caps 125, 127 are illustrated in the form of exemplary left and right end caps 125*a*, 127*a*. Each of the left end cap 125*a* and the right end cap 127*a* includes an end panel 167 and a tongue or projection 169 joined to and extending sideways from the end panel 167 and dimensioned and configured to be securely slidably received in a corresponding similarly shaped opening in the head rail 103 (see FIG. 1). The right end cap 127*a* includes a bracket arm 171*a* joined to and extending upwardly from the end panel 167, and the left end cap 125*a* includes a bracket arm 171*b* joined to and extending upwardly from the end panel 167. Each of the bracket arms 171 a, 171 b includes an end 173 at which the right and left end caps 127*a*, 125*a*, respectively, are operably coupled to the roller 117 (FIG. 10) of the roller shade 115 (FIG. 1). At the end 173 of the bracket arm 171*a* of the right end cap 127*a*, a hole 177 is defined, and at the end 173 of the bracket arm 171 b of the right end cap 127*a*, a slot 175*a* is defined. The slot 175*a* is rectangular in shape to receive the similarly shaped pin 161 (FIG. 10) of the roller 117 (FIG. 10), and to prevent the pin 161 from rotating relative to the left end cap 125*a* in accordance with conventional roller shade functionality. The hole 177 is circular in shape to receive a cylindrically shaped pin (see FIG. 2) on the opposite side of the roller 117 (FIG. 2) and to allow such pin to rotate relative to the right end cap 127*a*, also in accordance with conventional roller shade functionality.

Figure 15:
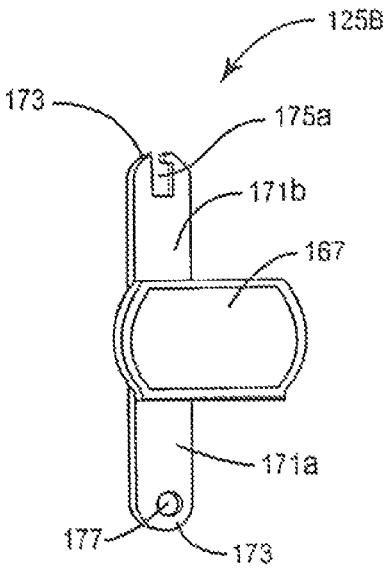
FIG. 15 is an end view of a modified version of the left end cap of FIG. 1.
Figure 16:
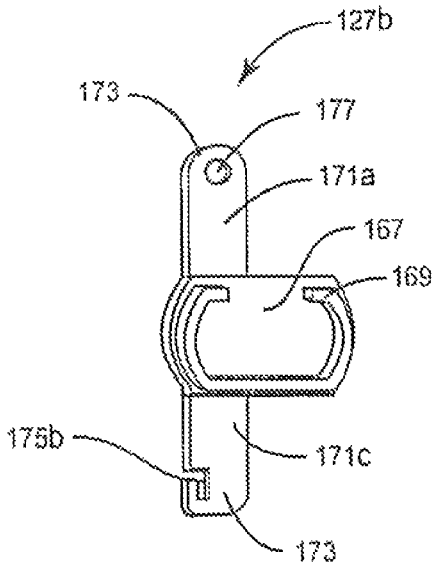
FIG. 16 is an end view of a modified version of the right end cap of FIG. 1.
Figure 15A:
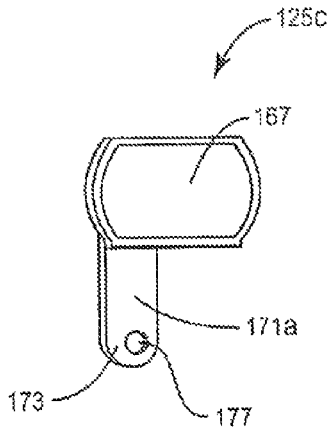
FIG. 15A is a end view of a modified version of the left end cap of FIG. 1.
Figure 16A:
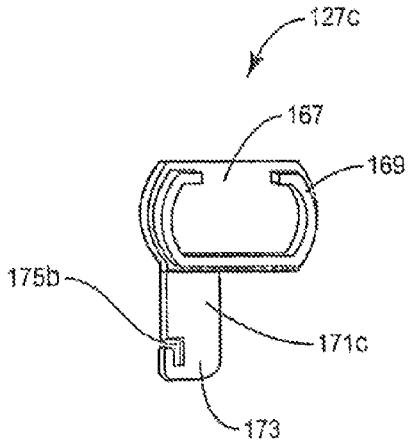
FIG. 16A is an end view of a modified version of the right end cap of FIG. 1.

Referring now to FIGS. 15 and 16, alternative configurations for the left end cap 125 and the right end cap 127 are illustrated in the form of a left end cap 125*b* and a right end cap 127*b*, respectively. Each of the left end cap 125*b* and the right end cap 127*b* includes an end panel 167, and a tongue or projection 169 joined to and extending laterally from the end panel 167 and dimensioned and configured to be securely and slidably received in a corresponding similarly shaped opening in the head rail 103 (see FIG. 1). The left end cap 125*b* further includes a bracket arm 171*b* joined to and extending in a first direction from the end panel 167 and a bracket arm 171*a* joined to and extending in a second direction from the end panel 167 opposite the first direction. The right end cap 127*b* further includes a bracket arm 171*c* joined to and extending in a first direction from the end panel 167 and a bracket arm 171*a* joined to and extending in a second direction from the end panel 167 opposite the first direction. Each of the bracket arms 171*a*, 171*b*, 171*c* includes an end 173 at which the end cap 125*b*, 127*b* is configured to be operably coupled to the roller 117 (FIG. 10) of the roller shade 115 (FIG. 1). At the end 173 of the bracket arm 171 b of the left end cap 125*b*, a slot 175*a* is defined. At the end 173 of the bracket arm 171 a of the left end cap 125*b*, and at the end 173 of the bracket arm 171 a of the right end cap 127*b*, a hole 177 is defined. At the end 173 of the bracket arm 171*c* of the right end cap 127*b*, a slot 175*b* is defined. The slots 175*a*, 175*b* are rectangular in shape to receive the similarly shaped pin 161 (FIG. 10) of the roller 117 (FIG. 10), and to prevent the pin 161 from rotating relative to the left or right end cap 125*b*, 127*b* in accordance with conventional roller shade functionality. The holes 177 are circular in shape to receive a cylindrically shaped pin (see FIG. 2) on the opposite side of the roller 117 (FIG. 2) and to allow such pin to rotate relative to the left or right end cap 125*b*, 127*b* also in accordance with conventional roller shade functionality. The right and left end caps 125*b*, 127*b* may be used in one or more alternative embodiments of the shade assembly 101 (not separately shown), including embodiments in which the unused bracket arms are trimmed off of the respective end panels 167. For example, in embodiments in which the bracket arm 171 a is trimmed off the end panel 167 of the left end cap 125*b* and the bracket arm 171*b* is trimmed off the end panel 167 of the right end cap 127*b*, the result is the left and right end caps 125*a*, 127*a* as shown and discussed above with reference to FIGS. 13 and 14, in which the remaining bracket arms 171*a*, 171*b* extend upward from the respective end panels, allowing the roller of the roller shade to be mounted above the cellular shade (not separately shown). For another example, in embodiments in which the bracket arm 171*b* is trimmed off the end panel 167 of the left end cap 125*b* and the bracket arm 171*a* is trimmed off the end panel 167 of the right end cap 127*b*, the result is the left and right end caps 125*c*, 127*c* as shown in FIGS. 15A and 16A, in which the remaining bracket arms 171*a*, 171*c* extend downward from the respective end panels, allowing the roller of the roller shade to be mounted below the cellular shade (not separately shown).

Figure 17:
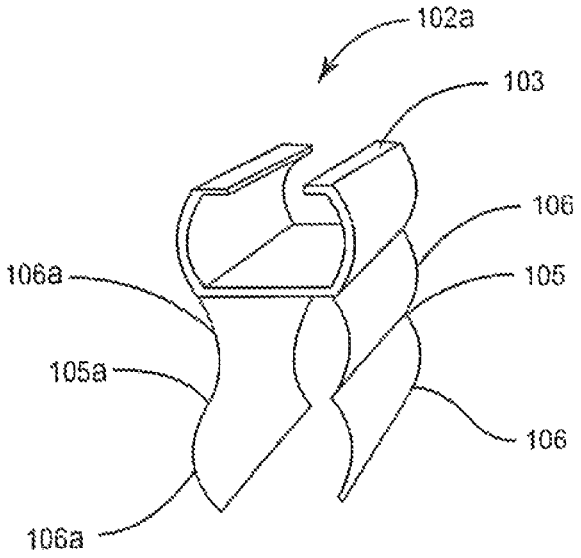
FIG. 17 is a downward side perspective view of a modified version of the body component of the shade assembly of FIG. 1.

Referring now to FIG. 17, an alternative embodiment of the body component 102 (FIG. 1) of the shade assembly 101 (FIG. 1) is shown in the form of a body component 102*a*. Similar to the body component 102, the body component 102*a* includes a head rail 103 and a skirt 105 having multiple vertical segments 106 configured in such a way as to present a bumped or scalloped appearance to the skirt 105. In addition, the body component 102*a* includes a skirt 105*a* having multiple vertical segments 106*a* configured in such a way as to present a wave-like appearance to the skirt 105*a*. The body component 102*a* may be used in alternative embodiments of the shade assembly 101 (not separately shown), including embodiments in which the unused skirt is trimmed off of the head rail 103.

Figure 17A:
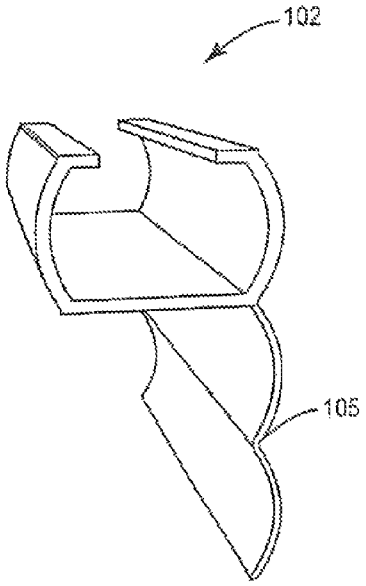
FIG. 17A is a downward side perspective view of the body component of the shade assembly of FIG. 1.

Turning now to FIG. 17A, the body component 102 of the shade assembly 101 (FIG. 1) is shown in isolation from other components. The body component 102 may be fabricated in the first instance as shown in FIG. 17A with only one skirt 105. Alternatively, the body component 102 may be fabricated with two skirts, one of which is removed, such that only the skirt 105 remains as shown in FIG. 17A. Other methods of fabrication are possible.

Figure 17B:
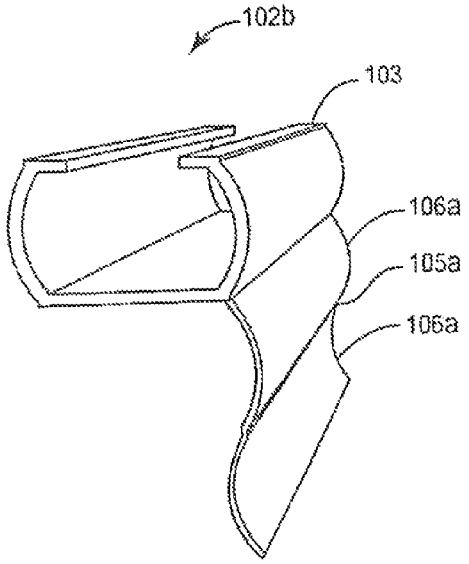
FIG. 17B is a downward side perspective view of a modified version of the body component of the shade assembly of FIG. 1.

Referring now to FIG. 17B, another alternative embodiment of the body component 102 (FIG. 1) is shown in the form of a body component 102*b*. The body component 102*b* includes a head rail 103 and a skirt 105*a* having multiple vertical segments 106*a* configured in such a way as to present a wave-like appearance to the skirt 105*a*. The body component 102*b* may be fabricated in the first instance as shown in FIG. 17B with only one skirt 105*a*. Alternatively, the body component 102*b* may be fabricated with two skirts, one of which is removed, such that only the skirt 105*a* remains as shown in FIG. 17B. Other methods of fabrication are possible. The body component 102*b* may be used in an alternative embodiment of the shade assembly 101 (not separately shown).

Embodiments of the present disclosure include embodiments in which: 1) the cellular shade 107 is configured or formed from materials that render the cellular shade at least partially translucent, such that, at least when used alone, the cellular shade 107 will permit at least some soft or filtered light to pass into the building space within which the shade assembly 101 is mounted; and 2) the shade panel 119 of the roller shade 115 is a vinyl shade panel that is substantially opaque, such that, either when used alone, or together with the cellular shade 107, the shade panel 119 of the roller shade will provide for near total light blackout with respect to light entering the building space. Other configurations and materials for the cellular shade 107 and the shade panel 119 of the roller shade 115 are possible.

Embodiments of the present disclosure also include a method for manufacturing a double shade. The method includes providing a head rail, providing at least one end cap including an end panel and a bracket arm extending therefrom, providing a first window treatment, providing a second window treatment, and providing a clip. The method further includes mounting the end cap with an end of the head rail, mounting the first window treatment with the head rail, mounting the second window treatment with the bracket arm, and mounting the clip with the first window treatment and the second window treatment.

Variations of such method for manufacturing a double shade include wherein the first window treatment is part of a shade product previously equipped and configured to permit the first window treatment to be mounted adjacent to an appropriate architectural feature such as a window or alcove in the absence of the second window treatment. In accordance with such variations, such consumer product, in addition to including the first window treatment, further includes both a head rail to which the first window treatment is mounted and at least one existing side panel mounted at an end of the head rail, and such method includes removing the at least one existing side panel and replacing the same with the at least one end cap. Further in accordance with such variations, the first window treatment and the second window treatment are mountable together adjacent to the same architectural feature, wherein the clip, being mounted to the first and second window treatments, permits the window treatments to be raised or lowered together in unison.

Other variations and configurations with respect to such method for manufacturing a double shade are also possible, including variations in which the clip is selectively releasably mounted to: 1) the first window treatment; 2) the second window treatment; or 3) both the first window treatment and the second window treatment. Such variations provide a user of the double shade a beneficial flexibility with respect to available shading options and effects, including either using the first window treatment alone, which in certain configurations (such as wherein the first window treatment includes a cellular shade) will allow soft light illumination of the building space within which the double shade is mounted, or to use the first window treatment together with the second window treatment together, which in certain configurations (such as wherein the second window treatment includes a vinyl roller shade) will provide for a substantially complete blackout with respect to external light entering the space. Still further configurations are possible in accordance with the present disclosure.

Figure 18:
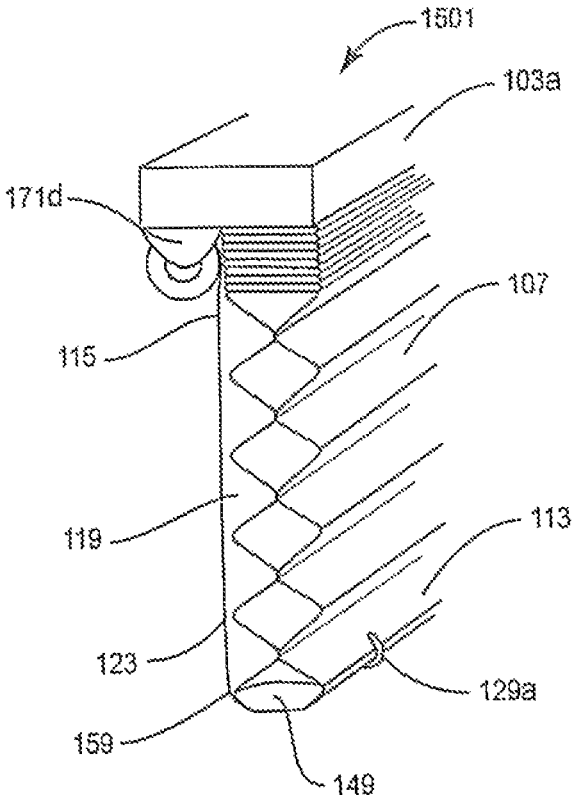
FIG. 18 is downward side perspective view of one embodiment of a shade assembly in a partially vertically extended configuration in accordance with the principles of the present disclosure.
Figure 19:
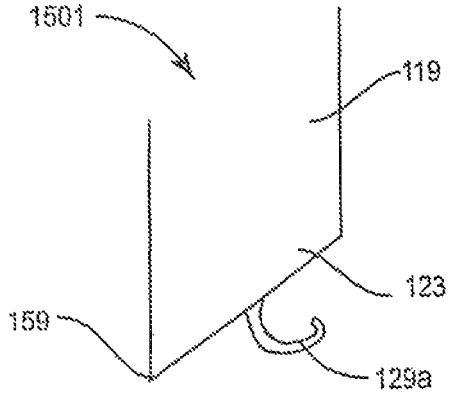
FIG. 19 is a downward side perspective detail view of part of the shade assembly of FIG. 15.

Turning now to FIGS. 18 and 19, an alternative embodiment of the shade assembly 101 (FIG. 1) is shown in the form of a shade assembly 1501. The shade assembly 1501 is a fixed roller/fixed cell shade assembly, similar to the shade assembly 101 (FIG. 1). The shade assembly 1501 includes no skirt (but may for aesthetic reasons), but includes a head rail 103*a* having a horizontal depth dimension that is greater than that that of the head rail 103, and is sufficiently large such that the head rail 103*a* is disposed above both the cellular shade 107 and the roller shade 115. The roller shade 115 is coupled to the head rail 103*a* by means of a bracket arm 171 d extending downwardly from the head rail 103*a*. Instead of including a clip component 129 (FIG. 1) that is selectively removably coupled to the respective lower margins 113, 123 of the cellular shade 107 and the shade panel 119 of the roller shade 115, the shade assembly 1501 includes a relatively slender clip arm 129*a* joined to the bottom rail 159 of the shade panel 119 of the roller shade 115, and extending toward the cellular shade 107. As shown in FIGS. 18 and 19, the clip arm 129*a* is configured to be selectively removably coupled to the bottom rail 149 of the cellular shade 107.

Figure 20:
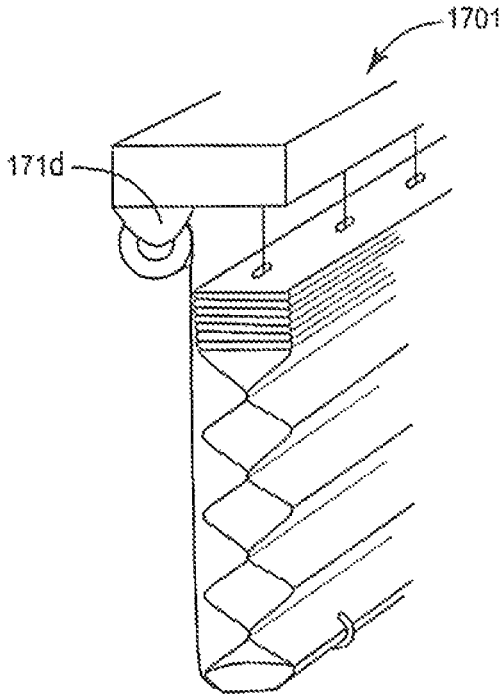
FIG. 20 is a downward side perspective view of one embodiment of a shade assembly in a partially vertically extended configuration in accordance with the principles of the present disclosure.

Turning now to FIG. 20, an alternative embodiment of the shade assembly 101 (FIG. 1) is shown in the form of a shade assembly 1701. The shade assembly 1701 is similar to the shade assembly 1501 of FIGS. 18 and 19, except that the shade assembly 1701 is a fixed roller/TDBU cell shade assembly. The cell shade assembly is a TDBU version. The cell shade assembly can incorporate a cord pull/release to lower or raise the upper portion of the cellular shade, or may have a 'smart TDBU' configuration in which the user simply lowers or raises the upper portion of the cellular shade without cords.

Figure 21:
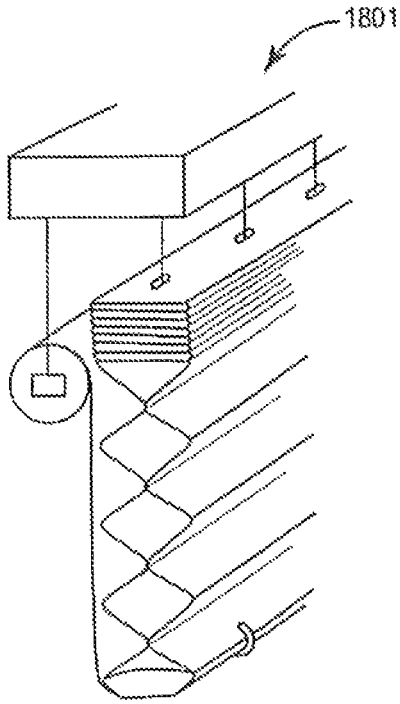
FIG. 21 is a downward side perspective view of one embodiment of a shade assembly in a partially vertically extended configuration in accordance with the principles of the present disclosure.

Turning now to FIG. 21, an alternative embodiment of the shade assembly 101 is shown in the form of a shade assembly 1801. The shade assembly 1801 is similar to the shade assembly 1701 of FIG. 20, except that the shade assembly 1801 lacks the bracket arm 171*d* (see FIG. 20) and is a TDBU roller/TDBU cell shade assembly.

Referring now to FIG. 22, brackets 179 are shown. The brackets 179 are configured and dimensioned to mount the body component 102 to a wall surface or ceiling surface above or adjacent to an architectural feature such as an alcove or window brackets similar to the brackets 179. For example, the brackets 179 include an upper arm 181, a rear arm 183, a pair of through holes 185 extending through the upper arm 181 to accommodate screws for mounting the body component 102 to a horizontal or ceiling surface (not shown), and a pair of through holes 185 extending through the rear arm 183 to accommodate screws for mounting the body component 102 to a vertical or wall surface (not shown). In embodiments in accordance with the principles of the present disclosure in which the roller 117 of the roller shade 115 is disposed beneath and behind the cellular shade 107, variations of the brackets 179 are provided in which the upper arm 181 is extended as needed to provide the necessary space for roller shade inclusion. In embodiments in accordance with the principles of the present disclosure in which the roller 117 of the roller shade 115 is disposed beneath and behind the cellular shade 107, variations of the brackets 179 are provided in which the rear arm 183 is extended as needed to provide the necessary space for roller shade inclusion. Other variations of the brackets 179 are possible.

Figure 23:
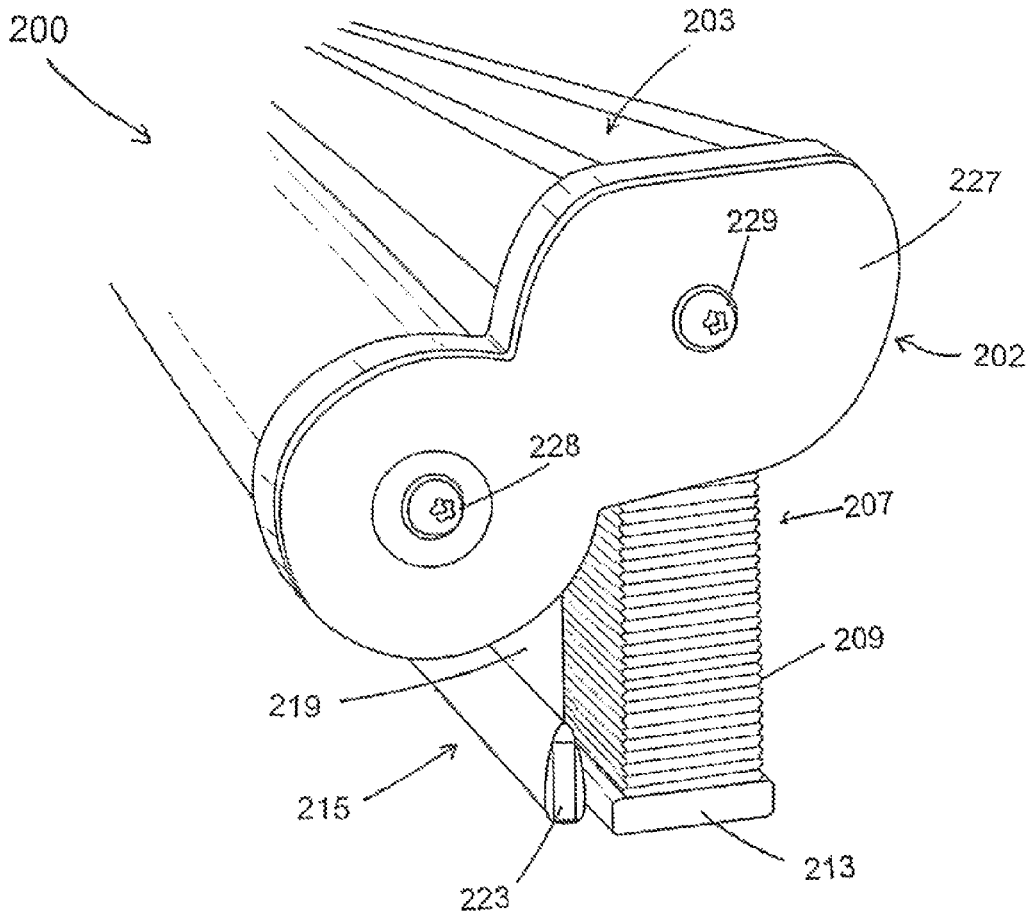
FIG. 23 is a perspective view of an embodiment of the invention.
Figure 24:
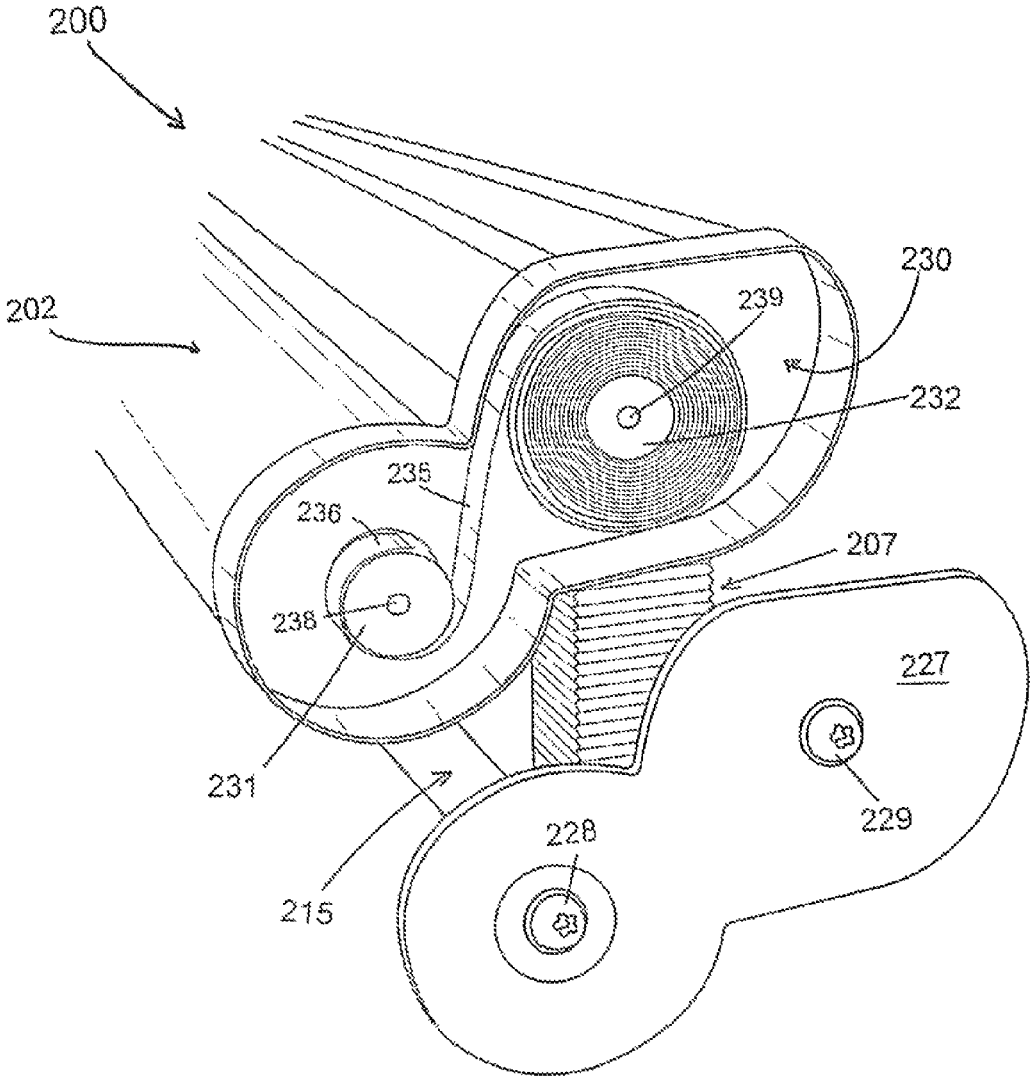
FIG. 24 illustrates the embodiment of FIG. 23 with the end plate removed.

Referring now to FIGS. 23 and 24, cordless shade assembly 200 includes a body component 202 including a headrail 203. A first window treatment, i.e., cellular shade 207 including multiple cells 209 and having a lower margin affixed to bar 213 is mounted at its upper end to body 202. A second window treatment, i.e., roller shade 215, includes a shade panel 219 having a lower margin attached to a bar 223 and an upper margin attached to a roller 231 rotatably mounted in body 202. When the roller shade 215 is in a retracted raised position, spring 235 is unwound around roller 231, but wound around roller 232. When the roller shade 215 is in an extended lowered position the shade panel 219 is withdrawn from the body and spring 235 is wound around the roller 231, and unwound from roller 232. The body includes at least one end cap 227, which covers an internal space 230. A roller 232 is disposed within the internal space 230 and a spring member 235 is coiled around roller 232. An end 236 of spring 235 is affixed to roller 231 such that spring 235 can be unwound from roller 232 and concurrently wound around roller 231. The panel shade 215 as well as the cellular shade 207 are raised or lowered by lifting or pulling down bar 223 and/or bar 213. This movement transfers the spring member 235 between rollers 231 and 232. Plate 227 can be secured by means of fasteners 228 and 229 disposed through corresponding opening 238 and 239 in the rollers 231 and 232.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A double shade apparatus comprising:

a) a body component including a head rail;

b) first and second end panels attached respectively to opposite ends of the head rail, each end panel having a bracket;

c) a roller shade apparatus mounted between the brackets of the first and second end panels;

d) a second shade apparatus mounted to the head rail; and, e) a clip for releasably engaging the roller shade apparatus with the second shade apparatus, wherein the roller shade apparatus includes a flexible shade material and the second shade apparatus includes a cellular shade material and the clip is independently releasably attachable to both a bottom of the flexible shade material and a bottom of the cellular material wherein the second shade apparatus includes a cellular shade rail attached to a bottom edge of the cellular shade material and the clip is configured and dimensioned to releasably engage the cellular shade rail wherein the clip includes an arcuate body portion forming a pocket in which the cellular shade rail is seated, and wherein the roller shade apparatus includes a rod attached to a bottom of the flexible shade material, and the clip includes a C-shaped extension for gripping said rod.

2. The double shade apparatus of claim 1 wherein the roller shade apparatus includes a flexible shade material which can be moved between a coiled configuration wherein said shade material is wound around a roller rotatably disposed between the brackets of the first and second end panels, and an extended planar configuration wherein the shade material is withdrawn from the roller.

3. The double shade apparatus of claim 2 wherein the shade material is substantially opaque.

4. The double shade apparatus of claim 1 wherein the second shade apparatus includes a flexible cellular shade material having horizontally extending cells in a vertical arrangement which can be moved between a retracted first position wherein the cells are folded closed and a second extended position wherein the cells are open.

5. The double shade apparatus of claim 4 wherein the cellular shade material is transparent or translucent.

6. The double shade apparatus of claim 1 wherein the body component includes a skirt depending from at least one side of the head rail.

7. The double shade apparatus of claim 6 wherein the skirt comprises at least two horizontally extending segments connected to each other in a vertical arrangement.

8. The double shade apparatus of claim 7 wherein the segments are arcuate.

9. A double shade apparatus comprising:

a) a body component including a head rail;

b) first and second end panels attached respectively to opposite ends of the head rail, each end panel having a bracket;

c) a roller shade apparatus mounted between the brackets of the first and second end panels;

d) a second shade apparatus mounted to the head rail; and, e) a clip for releasable engaging the roller shade apparatus with the second shade apparatus, wherein the roller shade apparatus includes a flexible shade material and the second shade apparatus includes a cellular material and the clip is independently releasably attachable to both a bottom of the shade material and a bottom of the cellular material, wherein the second shade apparatus includes a cellular shade rail attached to a bottom edge of the cellular shade material and the clip is configured and dimensioned to releasably engage the cellular shade rail, wherein the clip includes an arcuate body portion forming a pocket in which the cellular shade rail is seated, and wherein the roller shade apparatus includes a rod attached to a bottom of the flexible shade material and a latching member attached to the rod, wherein the clip includes a catch portion for engaging the latching member.

10. The double shade apparatus of claim 9 wherein one or both of the clip and latching member are magnetic.

11. The double shade apparatus of claim 4 further comprising at least one pull cords for raising or lowering the cellular shade material.

12. The double shade apparatus of claim 1 including a coil spring member mounted to two rollers and movable between them in a wound configuration in response to manual lifting or lowering the roller shade apparatus and second shade apparatus without the use of a pull cord.

13. A method for manufacturing a double shade, the method comprising:

providing a head rail;

providing at least one end cap including an end panel and a bracket arm extending therefrom;

providing a first window treatment;

providing a second window treatment including a flexible shade material and a rod attached to the bottom of the flexible shade material;

providing a clip having a C-shaped extension for gripping the rod;

mounting the end panel of the end cap with an end of the head rail;

mounting the first window treatment with the head rail;

mounting the second window treatment with the bracket arm;

mounting the clip with the first window treatment and the second window treatment; and attaching a latching member to the rod at the bottom of the flexible shade material, wherein one or both of the clip and the latching member are magnetic.

14. The method of claim 13 wherein the first window treatment comprises a shade apparatus including a transparent or translucent cellular shade.

15. The method of claim 14 wherein the flexible shade material comprises an opaque shade.

16. The method of claim 15 wherein the clip is releasably and individually attachable to a bottom of the translucent cellular shade and to a bottom of the opaque shade.

17. The method of claim 15 wherein the clip is releasably attachable to a bottom of the translucent cellular shade and the latching member.

* * * * *